US005742878A

United States Patent [19]

Kuroda

[11] Patent Number: 5,742,878

[45] Date of Patent: Apr. 21, 1998

[54] DETACHABLY MOUNTED IMAGE HEATING APPARATUS HAVING HEATER, FILM GUIDING MEMBER AND COVER

[75] Inventor: Akira Kuroda, Yokohama, Japan

[73] Assignee: Canon Kabushiki Kaisha, Tokyo, Japan

[21] Appl. No.: 510,289

[22] Filed: Aug. 2, 1995

Related U.S. Application Data

[63] Continuation of Ser. No. 77,541, Jun. 17, 1993, abandoned.

[30] Foreign Application Priority Data

Jun. 17, 1992 [JP] Japan ..... 4-157905

[51] Int. Cl.[6] ..... G03G 15/20

[52] U.S. Cl. ..... 399/122; 219/216; 399/329

[58] Field of Search ..... 355/200, 285, 355/290, 289; 399/122, 329; 219/216

[56] References Cited

U.S. PATENT DOCUMENTS

| | | | |
|---|---|---|---|
| 4,287,021 | 9/1981 | Justus et al. | 162/358 |
| 4,954,845 | 9/1990 | Yano et al. | 355/290 |
| 5,026,276 | 6/1991 | Hirabayashi et al. | 432/59 |
| 5,148,226 | 9/1992 | Setoriyama et al. | 355/290 |
| 5,149,941 | 9/1992 | Hirabayashi et al. | 219/216 |
| 5,179,263 | 1/1993 | Koh et al. | 219/216 |
| 5,179,415 | 1/1993 | Ikematsu et al. | 355/290 |
| 5,196,895 | 3/1993 | Setoriyama et al. | 355/285 |
| 5,210,579 | 5/1993 | Setoriyama et al. | 355/285 |
| 5,343,279 | 8/1994 | Nagata et al. | 355/285 |

*Primary Examiner*—William J. Royer

*Attorney, Agent, or Firm*—Fitzpatrick, Cella, Harper & Scinto

[57] ABSTRACT

An image heating apparatus includes a heater; an endless film extended around the heater; a guiding member for guiding an internal surface of the film; a driving rotatable member for driving an outer surface of the film; wherein the heater, the film and the guiding member constitute a unit which is detachably mountable to the image heating apparatus with the driving rotatable member maintained in the image heating apparatus.

8 Claims, 16 Drawing Sheets

DETACHABLY MOUNTED IMAGE HEATING APPARATUS HAVING HEATER, FILM GUIDING MEMBER AND COVER

This application is a continuation of application Ser. No. 08/077,541, filed Jun. 17, 1993, now abandoned.

FIELD OF THE INVENTION AND RELATED ART

The present invention relates to an image heating apparatus comprising a heater, and an endless film extended around the heater, in which an image on a recording material is heated by heat from said heater through said film.

An image heating apparatus has been proposed which comprises a fixed heater, a heat resistive fixing film moved in press-contact with the heater at the inside surface of the fixing film, and a pressing roller for pressing a transfer sheet toward the heater through the fixing film, so that the heat is applied onto the transfer sheet through the fixing film, by which an unfixed image is fixed on the transfer sheet.

Referring first to FIG. 16, there is shown an example of such a film heating apparatus. The endless film 201 is trained around a driving roller TR1, a tension roller TR2 and a heater 203. Designated by a reference numeral 202 is a pressing roller, and P is a transfer sheet.

FIG. 17 is a sectional view of a tensionless type image heating apparatus. The tensionless type has been proposed in U.S. Pat. No. 5,148,226 and Ser. No. 712,532.

The fixing film 204 is advanced by friction force between the pressing roller 202, the heater 203 and The transfer sheet P. The lateral shifting tendency of the fixing film 204 occurring during advancement of the fixing film is controlled by a limiting member 205 at a lateral end portion of the fixing film 204.

Designated by a reference numeral 206 is a fixing film guide, and the fixing film supporting surface of the guide 206 extends over the entire longitudinal length.

The fixing film 204 rotationally traveling by the force applied by the pressing roller 202 is laterally shifted in an uncontrollable direction, because of dimensional variations of the inside diameter of the fixing film 204 and the outside diameter of the pressing roller 202, or because of non-uniform distribution of the temperature or pressure in the longitudinal direction of the heater 203. As a result, depending on the film thickness or material of the fixing film 204, end portions of the fixing film limited by the limiting member 205 are folded, creased or cracked, with the further result of deterioration of the fixed image or disablement of the fixing film 204 travel.

When an image forming apparatus having such a heating apparatus for fixing toner images by heating and pressing on the transfer sheet, is operated for a a long period of time, the fixing film tends to be damaged since it is rotated in press-contact with the heater having a high temperature for the purpose of fusing and fixing the toner. In addition, the surfaces of the fixing film and the pressing roller are contaminated with off set toner with the result of preventing satisfactory image formation. Therefore, it is desirable to replace the fixing film and the pressing roller, to clean the fixing film and to effect adjustment or replacement. Such maintenance operation is carried out by an expert service persons. Easy maintenance operations possible by the user has been proposed. However, in the apparatus described in conjunction with the Figures, the fixing film is stretched around the three members, namely, the roller TR1, the roller TR2 and the heater. Therefore, there are following problems in the assembling, maintenance and part replacement in the fixing device.

(1) It is difficult in the assembling and maintenance that the three members, namely, the heater, the driving roller and the tension roller are fixed on a fixing device frame while stretching the fixing film around the three members. In addition, the positional accuracies among the fixing film, heater or another members is influenced by the assembling and maintenance, with the result of in tolerable snaking movement.

(2) In the heating apparatus, the fixing film which is exposed as shown in the Figure may be contaminated with dust or by contact by users finger or the like, with the possible result of a poor quality image fixing operation.

SUMMARY OF THE INVENTION

Accordingly, it is a principal object of the present invention to provide an image heating apparatus in which the folding or crease can be prevented at an end portions of the film.

It is another object of the present invention to provide an image heating apparatus with which maintenance or servicing operation is easy.

According to an aspect of the present invention, there is provided an image heating apparatus comprising: a heater; an endless film extended around said heater; a guiding member for guiding an internal surface of said film; a driving rotatable member for driving an outer surface of said film; wherein said heater, said film and said guiding member constitute a unit which is detachably mountable to said image heating apparatus with said driving rotatable member maintained in said image heating apparatus.

According to a further aspect of the present invention, there is provided an image heating apparatus, comprising: a heater; a loosely extended around said heater; a guiding member, disposed adjacent an end of said film, for guiding an internal surface of said film; a circumferential length of said guiding member is smaller than an internal circumferential length of said film and not smaller than 0.8 time the internal circumferential length of said film.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
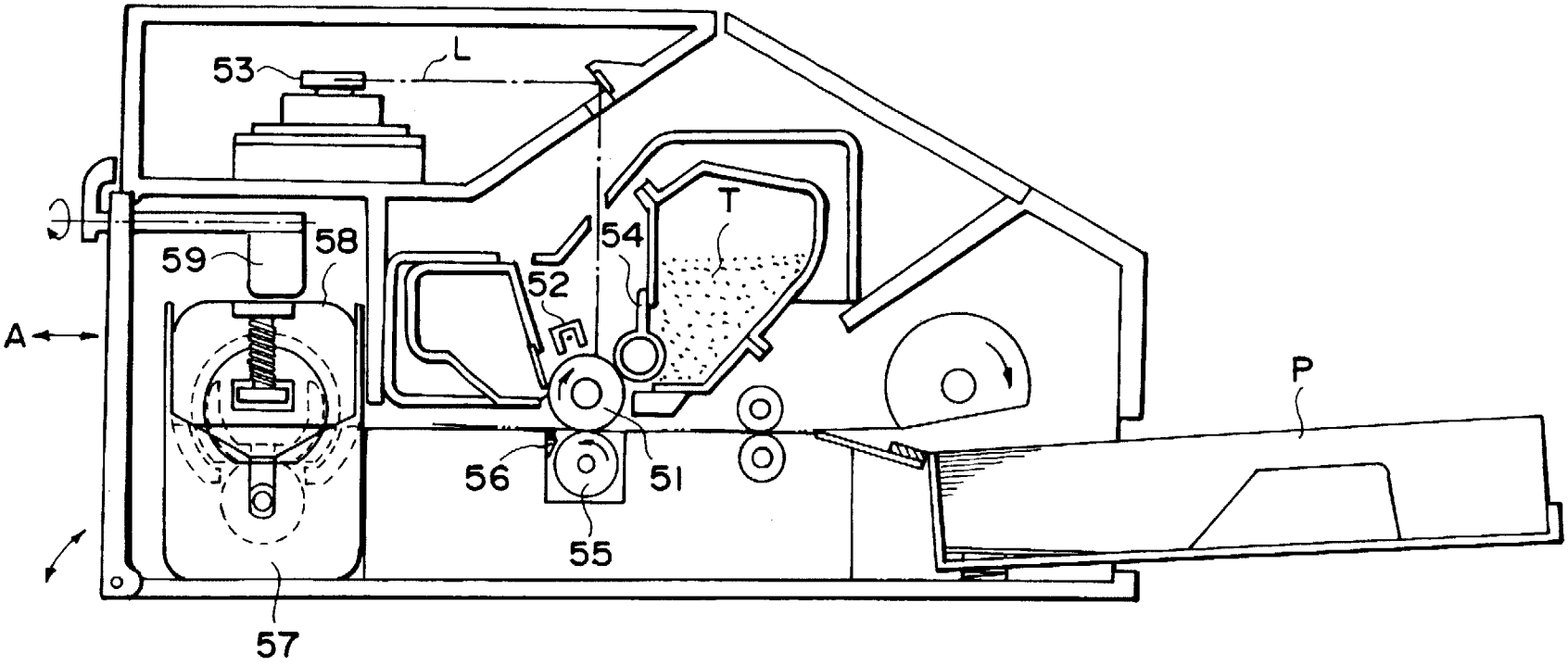
FIG. 1 is a sectional view of an image forming apparatus according to an embodiment of the present invention.

Referring to FIG. 1, there is shown an image forming apparatus using as an image fixing apparatus an image heating apparatus according to an embodiment of the present invention.

Designated by a reference numeral 51 is an electrophotographic photosensitive member, that is, drum rotated at a predetermined peripheral speed. The drum 51 is uniformly charged to a positive or negative predetermined potential by a primary charger 52, while it is being rotated. Then, it is exposed to scanning laser beam L bearing intended image formation by a laser scanner 52, so that an electrostatic latent image is formed on the drum 51. The surface of the drum 51 having a formed latent image is supplied with toner T by a developing device 54, and the latent image is visualized as a toner image. While passing through the position of the transfer roller 55, the toner image is continuously transferred onto a surface of a transfer sheet P which has been supplied to between the transfer roller 55 and the drum 51. The transfer from the drum 51 onto the transfer sheet P surface is effected by applying charge of the polarity opposite from that of the toner image onto the backside of the transfer sheet P surface by the transfer roller 55. Subsequently, the transfer sheet P is electrically discharged by discharging needles 56 to which a voltage of the polarity opposite to that of the transfer roller 55 is supplied, by which the transfer sheet P is separated from the drum 51. It is then introduced into a heating apparatus 57, where the toner T is heated and fused, and is fixed into a permanent image on the transfer sheet P. An upper fixing unit 58 is pressed or released by a rotatable lever 59 fixedly mounted to a frame of the image forming apparatus, and is detachably mountable as a unit in a direction of an arrow A. However, the direction of mounting or dismounting of the unit is not limited to the direction A.

Figure 2:
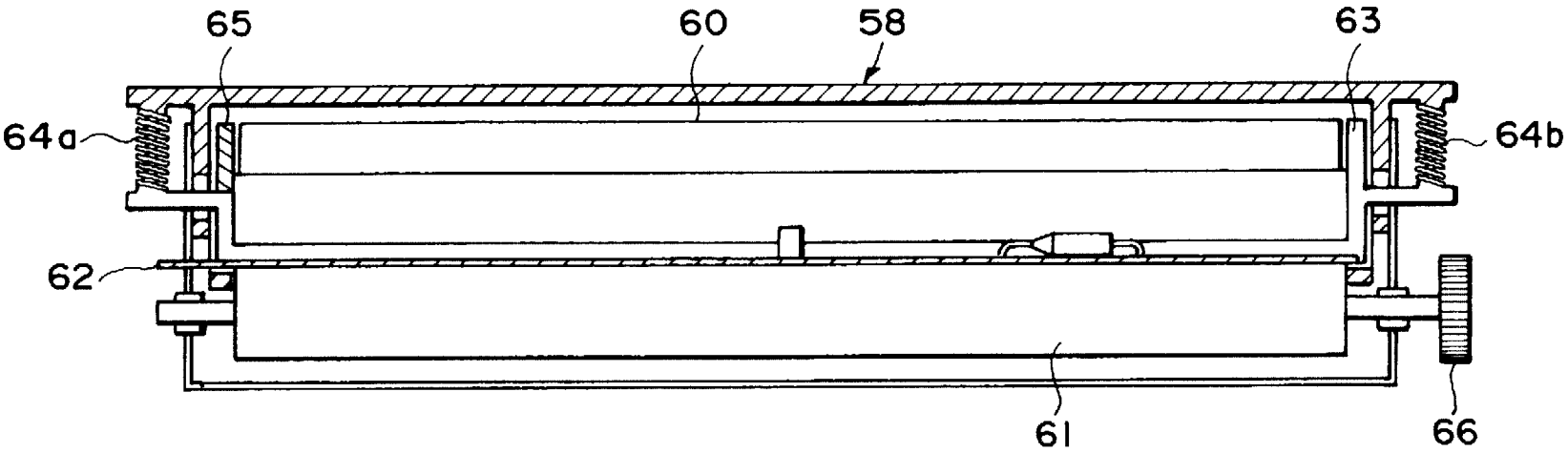
FIG. 2 is a sectional view of an image heating apparatus according to an embodiment of the present invention.
Figure 3A:
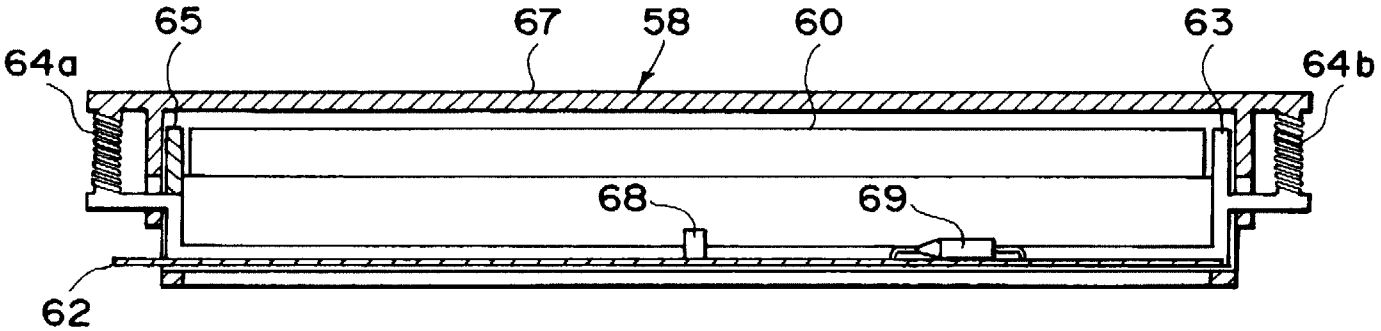
FIGS. 3A and 3B are a sectional view and a side view of an upper fixing unit.
Figure 3B:
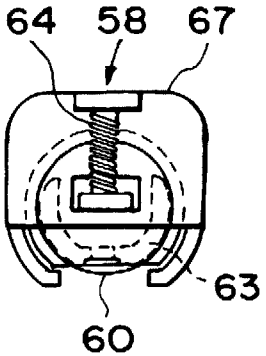

FIG. 2 is a sectional view of a heating apparatus, and FIGS. 3A and 3B are sectional and side views of an upper unit.

In the heating apparatus 57, the fixing film 60 is in the form of an endless cylinder, and no tension force is applied in the circumferential direction except for the nip formed with the pressing roller. It is rotated only by friction with the pressing roller 51. The fixing film 60 may be a single layer film having a heat resistivity, toner releasing property and toughness, or a multi-layer film with proper surface treatment or lamination. It may be a single layer film of polyester (PET) or polyimide (PI) having a thickness of approx. 50 micron and having been treated for heat resistivity, or a multi-layer film comprising said single layer film and parting layer of tetrafluoroethylene (PTFE) resin. Designated by a reference numeral 61 is a pressing member in the form of a pressing roller. A film guide 63 functions to support the heater 62 and to guide the inside surface of the fixing film 60 over the entire longitudinal range. The film guide 63 and the pressing roller 61 are press-contacted to each other with the fixing film 60 interposed therebetween by springs **64*a* and 64*b* at a predetermined contact pressure (total pressure of 3–6 kg in A4 width, for example). The heater 62 is fixed to the fixing film guiding member 63 at a position shown in the Figure. The heater 62 is a thin film heat generating resistor in the form of a line or stripe. The heater 62 is of $TiSiO_2$, silver-palladium, $Ta_2N$, $RuO_2$ or nickel-chrome and is formed on a ceramic substrate through evaporation, sputtering, CVD, screen printing or the like. A longitudinal end of the film guiding member 63 is formed into a flange, which is cooperative with a flange 65 at the other end, which is mounted during assembling, to limit the snaking movement of the fixing film 60 by limiting the longitudinal ends of the fixing film 60 by the flanges. The material of the film guiding member 63 may be metal, heat resistive resin material or the like. However, in this embodiment, in order to permit easy formation of end flange and the fixing film guide, the material is polyimide resin, a compound material of polyimide resin, glass fibers, ceramic material, fluorine resin material or the like, which exhibits heat resistivity, insulating property, toughness (high rigidity, durability against impact, mechanical strength), or thermo-setting resin such as phenol resin. The transfer sheet P having a transferred unfixed toner image is conveyed to a fixing nip together with the fixing film 60 by the surface friction of the surface of the pressing roller 61 driven by a driving gear 66, whereafter at least in the fixing nip, the transfer sheet P is advanced at the same peripheral speed as the fixing film 60 and the pressing roller 61 without relative sliding motion therebetween, by the contact pressure between the heater 62 and the pressing roller 61 by springs 64*a* and 64*b* by pressing down the upper fixing unit 58 containing the fixing film guiding member or the like to the pressing roller by urging means mounted to the main assembly of the image forming apparatus. While the transfer material P is being passed through the fixing nip (pressing step), the heat from the heater 62 is transmitted to the transfer sheet P through the fixing film 60, so that the unfixed toner image T is fused and pressed onto the transfer sheet P. After the transfer sheet P has passed through the fixing nip, the transfer sheet P is conveyed with the fixing film 60 which are closely contacted by the adhesive force of the toner T fused or softened (cooling step). During this, the heat is irradiated from the toner T, so that the toner T is cooled and solidified, by which a permanent fixed image is formed on the transfer sheet P. After the cooling step, the fixing film 60 is easily separated from the transfer sheet P, and the transfer sheet P is discharged from the heating apparatus 57** after the separation.

As shown in FIGS. 3A and 3B, lower parts of pressing and supporting portion of the fixing film guide 63 adjacent longitudinal ends thereof, are engaged to a frame of a fixing film protecting cover, and upper parts thereof are engaged to a frame of the fixing film protecting cover 67 through a pressing spring. The fixing film protecting cover 67 covers the fixing film 60 over the longitudinal range except for the portion of the fixing film 60 where it is contacted to the heater. The fixing film 60 at the heater side is covered by the cover 60 outside the transfer sheet passing region. When the upper fixing unit is placed on a table or floor with the heater face down, the fixing film is prevented from direct contact with the surface of the table or floor. The upper fixing unit 58 contains the heater 62, a heater temperature detecting element 68, a safety device 69 and a flange 65 at an end, which are fixed by unshown fixing means.

Figure 4A:
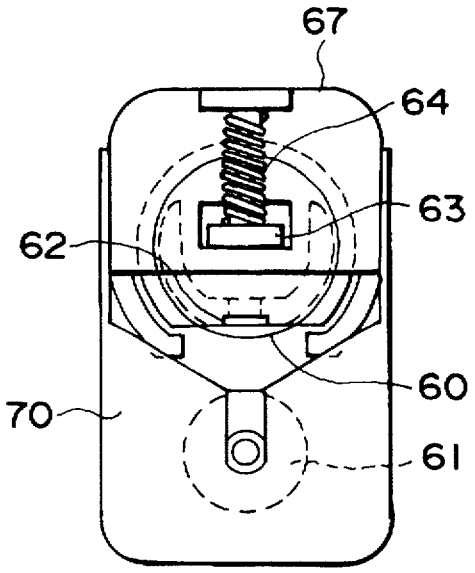
FIGS. 4A and 4B are side views of the units.
Figure 4B:
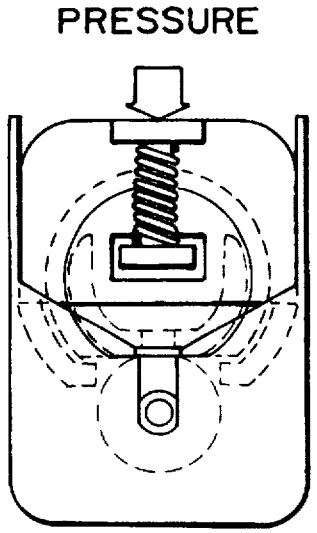

FIGS. 4A and 4B are side views of the upper fixing unit 58 before after incorporation in the heating apparatus 57. The fixing film protecting cover 67 is positioned relative to a frame 70 of the heating apparatus, and the fixing film protecting cover 67 is pressed down by a rotatable lever 57 mounted on the frame of the main assembly of the image forming apparatus, after it is placed in the heating apparatus 57. Then, the springs 64*a* and 64*b* applies the pressure required for the toner fixing between the heater 62 and the pressing roller 61. Since the unit 58 is detachably mountable with the pressing roller (driving roller for driving the film) left in the main assembly, the driving accuracy of the film is not deteriorated by the mounting or dismounting operation of the unit 58.

If the upper fixing unit is incorporated with the positioning relative to the heating apparatus frame, the fixing film, heater, the fixing film guide and the pressing roller or the like in the upper fixing unit, can be easily set with positional accuracy. Since it integrally has the cover, the upper fixing unit can be handled while it is protected with the fixing film protection cover, and therefore, the user is prevented from contacting the fixing film or the heater.

Since the fixing film is substantially covered by the fixing film protecting cover, the contamination or damage by contact thereto by users finger or the like, can be prevented, when a new upper fixing unit is mounted. When the upper fixing unit is placed on a table or floor with the heater facing down when the upper fixing unit is handled, the fixing film protecting cover is effective to protect the fixing film from direct contact with the floor surface or table surface, and therefore, the contamination or damage of the fixing film resulting in the poor fixing power, can be avoided.

Since the fixing film protecting cover is of a material having heat insulation effect, the heat produced at the heater is more transferred to the pressing roller through the fixing film rather than increasing the ambient temperature through the fixing film, so that the thermal efficiency is increased, so that lower energy is enough to fix the toner image.

Since the upper fixing unit is detachably mountable as a unit relative to the image forming apparatus, a jammed transfer sheet can be easily removed before and after the heating apparatus.

By adjusting the degree of press-down of the rotatable lever against the fixing film protecting cover, the pressure between the heater and the pressing roller can be adjusted. Therefore, suitable toner fixing operation can be provided corresponding to the material (thickness or the like of the transfer sheet) and the degree of curling of the transfer sheet discharged from the image forming apparatus can be minimized depending on the material of the transfer sheet. By providing a plurality of rotatable levers, and by adjusting the degrees of press-down, respectively, the sheet conveying powers of the pressing roller to the fixing film can be changed, thus adjusting the snaking force or direction of the fixing film. Therefore, the damage at end portions of the fixing film by the flanges can be minimized.

Figure 5:
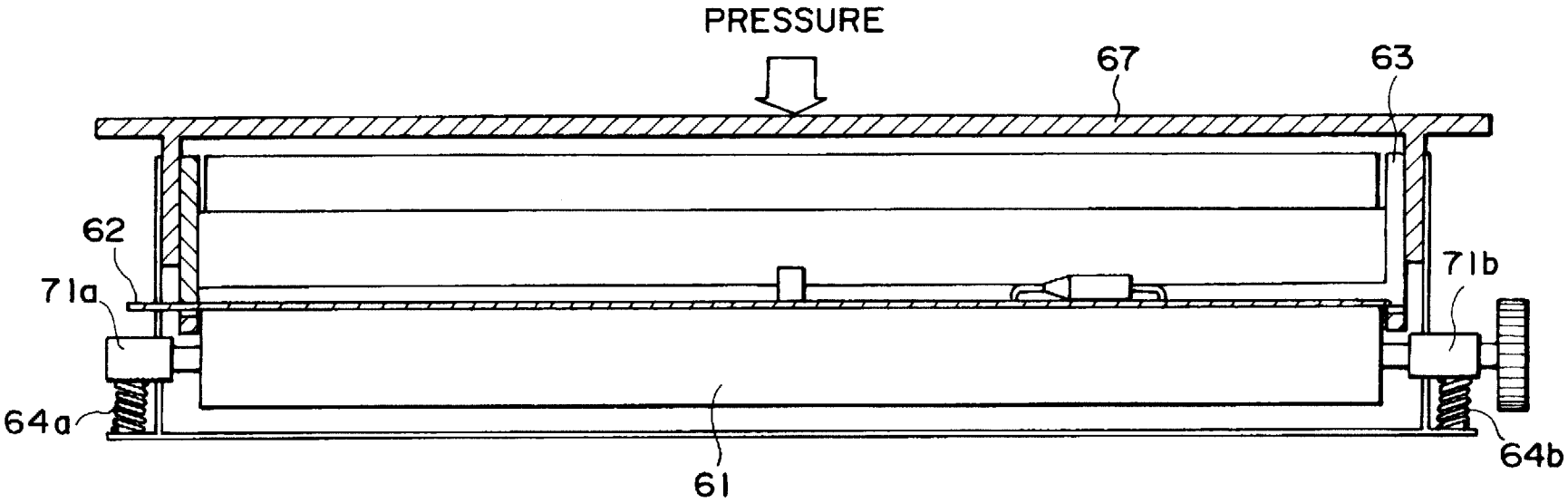
FIGS. 5, 6 and 7 are sectional views of the units according to other embodiments of the present invention.

FIG. 5 is a sectional view of a heating apparatus 57 usable with an image forming apparatus, according to another embodiment of the present invention. The various elements contained in the upper fixing unit 58 in the fixing film protecting cover 67, are similar to those of FIG. 2 embodiment. However, in this embodiment, the fixing film guide 63 is fixed on the fixing film protecting cover 67. The springs 64*a* and 64*b* are between the heating apparatus frame and the bearings 71*a* and 71*b* of the pressing roller. When the upper fixing unit 58 is pressed down by similar means as in FIG. 2 embodiment, a predetermined pressure is applied between the pressing roller 61 and the heater 62.

Since the structure of the apparatus of this embodiment is similar to that of FIG. 2 embodiment, the same advantageous effects as in the FIG. 2 embodiment can be provided. Additionally, the following advantageous effects can be provided by this embodiment.

Since the fixing film guide is fixed on the fixing film protecting cover, the relative positional accuracies among the fixing film, the fixing film guide and the heater contained in the upper fixing unit which is handles upon replacement, is enhanced, so that the travel of the fixing film is further stabilized.

Since the necessity of the spring for the upper fixing unit is eliminated, the assembling of the upper fixing unit is easier, and in addition, the manufacturing cost is decreased.

Figure 6:
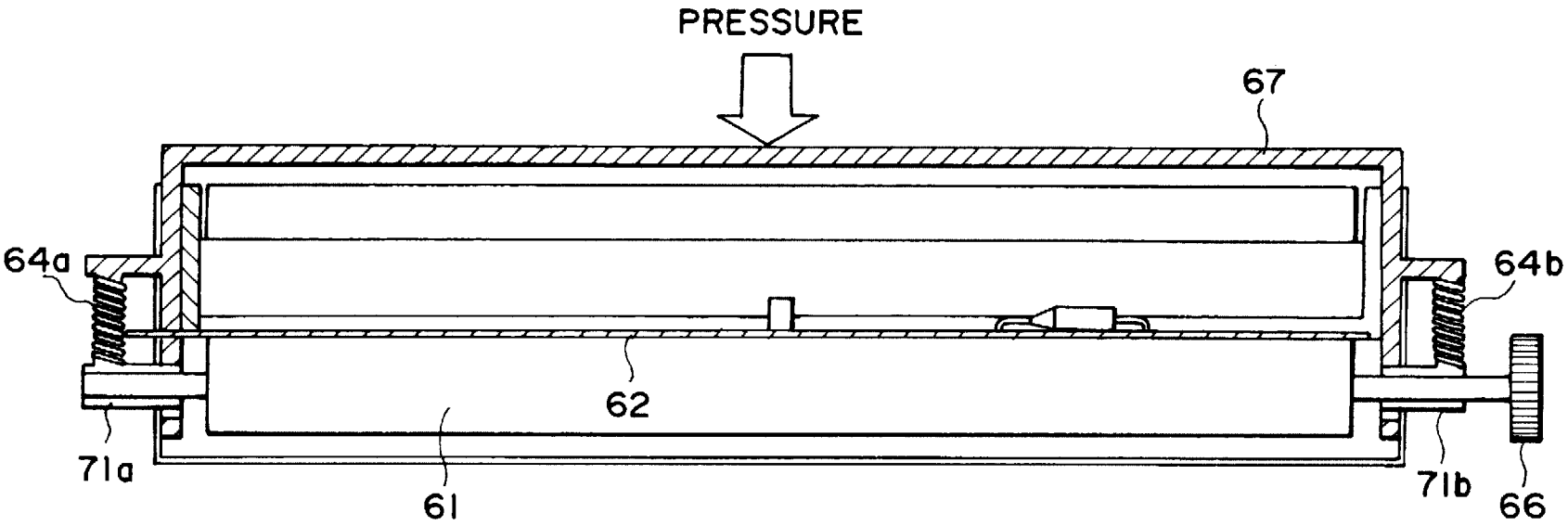

Referring to FIG. 6, there is shown a further embodiment in which the upper fixing unit 58 contains the same elements as those in the foregoing embodiments, as a unit. In this embodiment, the pressing roller 61 and the driving gear 66 are also contained in the upper fixing unit. The bearings 71*a* and 71*b* of the pressing roller 61 are supported by the fixing film protecting cover. In the upper fixing unit 58 of this embodiment, the springs 64*a* and 64*b* are between the fixing film protecting cover 67 and the bearings 71*a* and 71*b* for the pressing roller. When the upper fixing unit is incorporated to the heating apparatus frame 70, the bearings 71*a* and 71*b* of the pressing roller are abutted to the frame 70 of the heating apparatus. Thereafter, similarly to the foregoing embodiments, the fixing film protecting cover 57 is pressed down by a rotatable lever 59 mounted to the maim assembly of the image forming apparatus, so that a predetermined pressure is applied between The heater B2 and the pressing roller 61. The embodiment of FIG. 6 provides the same advantageous effects as in FIGS. 2 and 5 embodiments. In addition, this embodiments provides the following advantageous effects.

Since the pressing roller is contained in the upper fixing unit, the portion of the fixing film at the fixing nip can be protected by the pressing roller, as is different from FIGS. 2 and 5 embodiments. Therefore, upon the replacement of the upper fixing unit, the fixing film is prevented from direct contact thereto, thus contamination of the fixing film can be prevented.

Most of the major components of the heating apparatus is replaced by the replacement of the upper fixing unit, and therefore, easy and assured maintenance for the heating apparatus is possible by the replacement of the unit.

The relative positional accuracies among the guiding member, the heater and the fixing film are determined in the upper fixing unit, the positional relation between various members in the upper fixing unit and the pressing roller, heating apparatus and the image forming apparatus, are determined only by the positional relation between the upper fixing unit and the heating apparatus or the image forming apparatus. Since the fixing film protecting cover prevents direct contact of the user to the various members in the upper fixing unit including the fixing film, and therefore, the upper fixing unit can be safely exchanged by the user.

By the fixing film protecting cover containing the various members, the contamination or damage to the fixing film can be prevented not in normal use.

It is a possible alternative that the predetermined pressure is applied between the pressing member and the heater by the fixing film protecting cover receiving the pressure.

Figure 7:
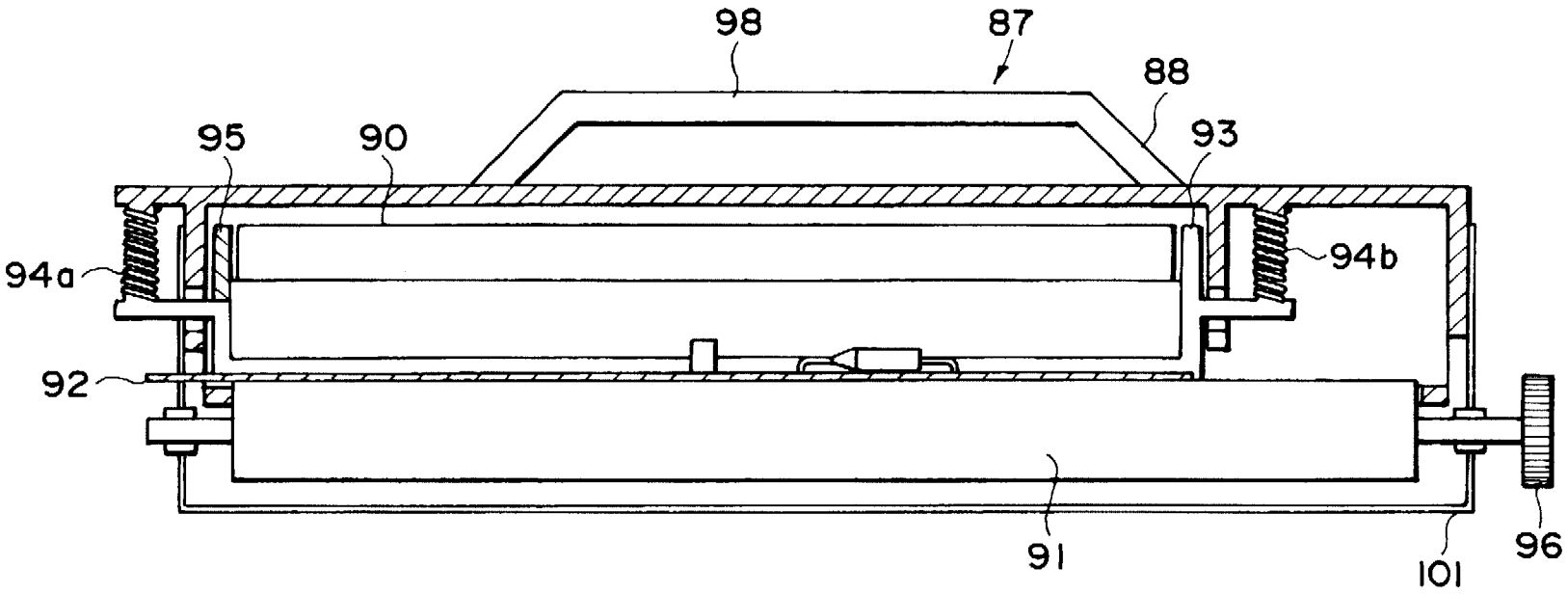

FIG. 7 is a sectional view of a heating apparatus 87 according to a further embodiment of the present invention. In the foregoing embodiments, the fixing film 90 is in the form of an endless cylinder, and no tension is applied in the circumferential direction except for the nip, and the fixing film 90 is rotated only by the friction force of the pressing roller 91. The fixing film 90, the roller 91, the heater 92, the guiding member 93, the springs 94*a* and 94*b*, the lever 89 are the like, are the same as in FIGS. 2–6, and are operated in the same manner as in FIG. 4.

In FIG. 7, an example is shown in which an upper fixing unit exclusively for A4 transfer sheet is mounted in the heating apparatus 87. The fixing film is suited for the width of A4 transfer sheet, and therefore, there is no sheet non-passage portion in the fixing nip, and therefore, the fixing film rotates stably.

Figure 8A:
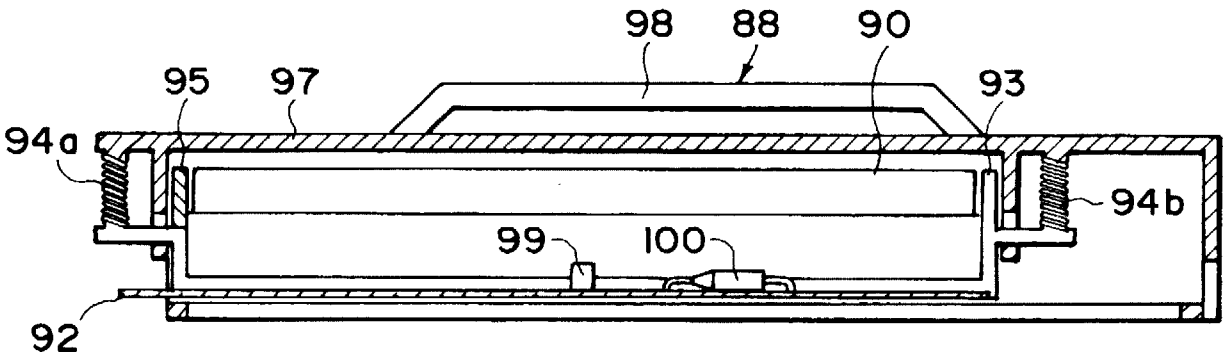
FIGS. 8A and 8B are sectional views and side views of upper fixing units of FIG. 7.
Figure 8B:
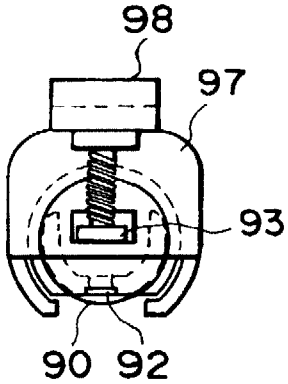

FIGS. 8A and 8B are sectional views and side views of the upper fixing unit 88. A lower part of a pressing and supporting portion of the fixing film guide 93 adjacent the longitudinal opposite ends, is engaged with a frame of the fixing film protecting cover 97, and the upper part thereof is engaged with the film protecting cover 97 through a spring. The fixing film protecting cover 97 covers the fixing film 90 over the longitudinal range except for a contact portion with the heater. A grip 98 is formed on the fixing film protecting cover 97 in this example. The upper fixing unit 88 contains the heater 92, the heater temperature detecting element 99, a safety device 100 and a flange 95 at one end, which are fixed by unshown fixing means.

Figure 9A:
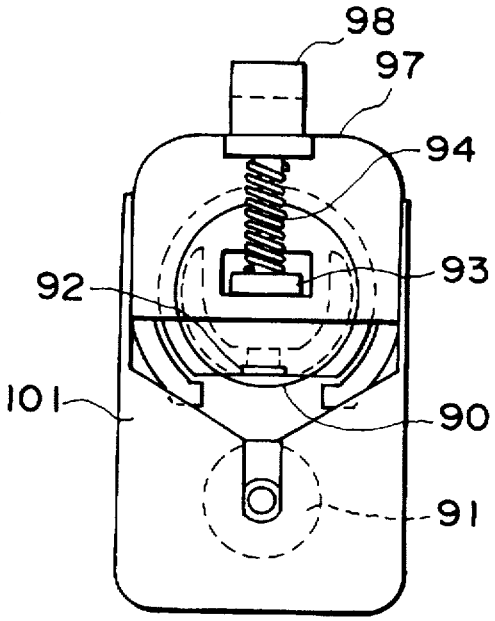
FIGS. 9A and 9B are side views of the upper fixing unit shown in FIG. 7.
Figure 9B:
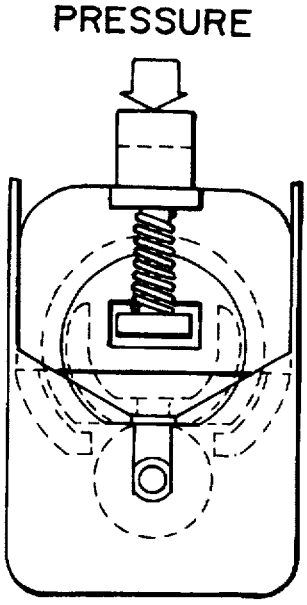

FIGS. 9A and 9B show the upper fixing unit 88 before and after it is mounted in the heating apparatus 87. The upper fixing unit 88 is positioned with the frame of the fixing film protecting cover 97 positioned relative to the heating apparatus frame 101, and is incorporated in the heating apparatus 87. Thereafter, an unshown rotatable lever mounted on the main assembly of the image forming apparatus, the fixing film protecting cover 97 is pressed down. With this state, the pressing springs 94*a* and 94*b* apply the pressure required for the toner fixing between the heater 92 and the pressing roller 91.

This embodiment provides the following advantageous effects.

The upper fixing unit is provided in accordance with a width of the transfer sheet. More particularly, the fixing film has a length corresponding to the width of the transfer sheet, and therefore, the fixing film is rotated stably because there is no difference between the sheet passing portion and the sheet non-passage portion depending the size of the used transfer sheet. Therefore, it does not occur that a longitudinal end of the fixing film is always in contact with a limiting member, that a large shifting force is applied. Therefore, the durability of the fixing film is increased. In addition, good toner images are provided as a result of the stabilized movement of the film.

Since the length of the heater corresponds to the longitudinal length of the fixing film, the heating apparatus is always operated with the minimum power consumption as long as the upper fixing unit for the used transfer sheet is used. Therefore, the image fixing operation can be performed with low energy consumption. In addition, the temperature in the image forming apparatus is prevented from rising.

The operator handles the upper fixing unit by the grip, and therefore, the fixing film contained in the upper fixing unit is moved or loaded into the heating apparatus or the image forming apparatus while being stably maintained horizontally at all times. The grip may function as a guide upon the mounting or dismounting of the upper fixing unit. If the grip is coated with fur or is provided with ribs or the like, the temperature of the grip will not be increased too much.

Figure 10:
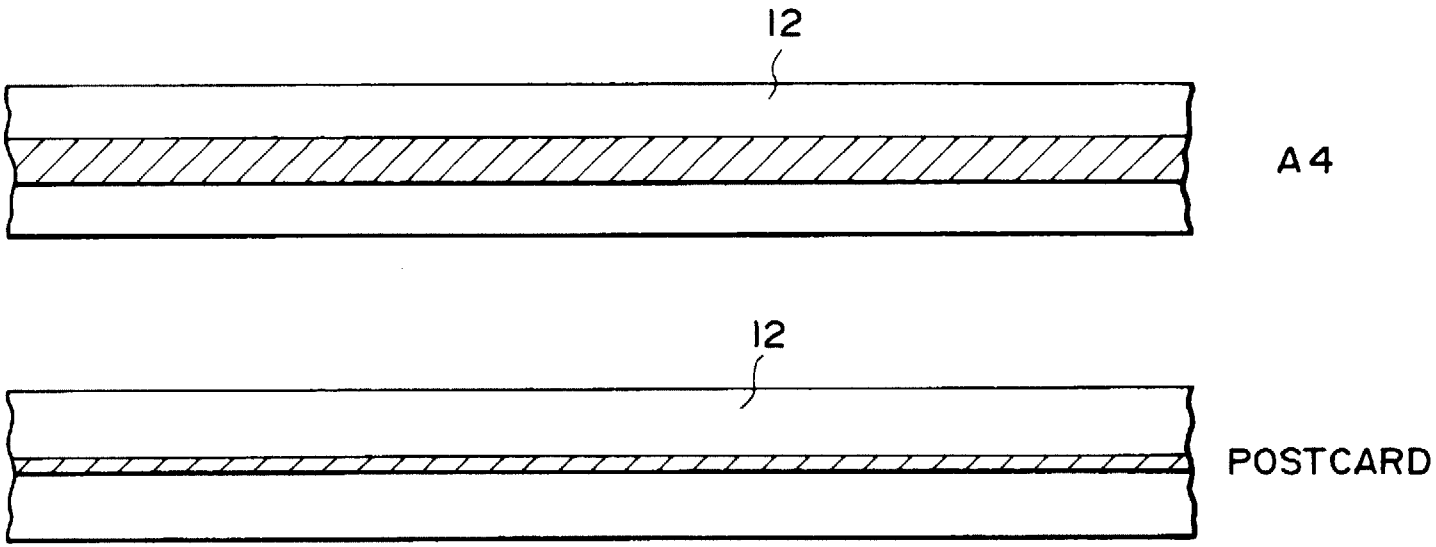
FIG. 10 is a top plan view of a heater according to a further embodiment of the present invention.

Referring to FIG. 10, there is shown a further embodiment. It shows a heat generating pattern of the heater contained in the upper fixing unit. The heaters in the upper fixing units for the respective sizes of the transfer sheet (widths), have not only different length but also different heat generating pattern (resistance), in accordance with the size of the transfer sheet. As shown in FIG. 10, the heater pattern in the upper fixing unit exclusively for post cards, has a narrow pattern as compared with the heater pattern of a unit exclusively for A4 sheet, in order to meet the relatively thick and hard material, thus providing a larger electric power when a voltage is constant.

Thus, by using a heater for a particular size of the transfer sheet in the upper firing unit for the particular transfer sheet, the fixing film is stably rotated, and the good fixed images can be provided.

In a modified example of FIG. 10, another method is used to provide the stabilized rotation of the fixing film and the good image fixing. In this example, in place of increasing the heater output voltage, a spring having a larger spring constant is used for the spring in the upper fixing unit so as to meet a hard and thick transfer material such as post card. By doing so, the fused and therefore low viscosity toner more easily enter the fibrous heat, so that good fixed image can be provided.

Figure 11:
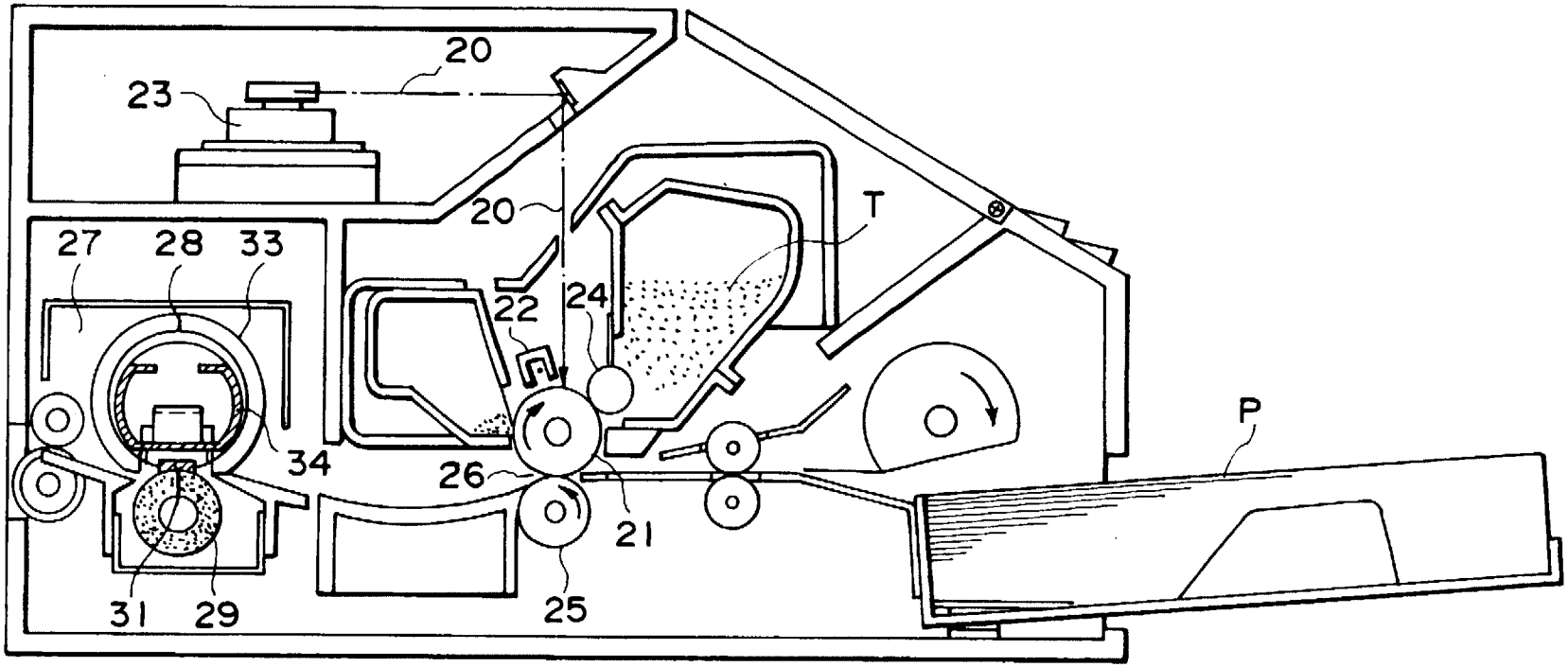
FIG. 11 is a sectional view of an image forming apparatus according to a further embodiment of the present invention.

Referring to FIG. 11, the description will be made as to a further embodiment which is in the form of a laser beam printer.

In FIG. 11, designated by a reference numeral 21 is an electrophotographic photosensitive member (drum) rotated at a predetermined peripheral speed. The drum 21 is uniformly charged to a positive or negative predetermined polarity by a primary charger 22 while it is being rotated, and is exposed to a laser scanning beam 20 bearing intended image information by a laser scanner 23, so that the image information is written thereon.

By this, an electrostatic latent image is formed on the drum 21. The surface of the drum 21 having the formed latent image is supplied with toner T in the developing device 24 so that it is visualized into a toner image. The toner image is continuously transferred onto a surface of a transfer sheet P which has been fed to between the transfer roller 25 and the drum 21, while it is being passed through the transfer roller 25 position. The transfer from the drum 21 onto the surface of the transfer sheet P is carried out by apply electric charge having a polarity opposite to that of the toner image onto the backside of the transfer sheet P by a transfer roller 25. Then, the transfer sheet P is electrically discharged by discharging needles 26 supplied with a voltage of the polarity opposite from that of the transfer roller 5, and is separated from the drum 21. It is then introduced into a heating apparatus 27, which heats and fuse the toner T on the surface of the transfer sheet P and fixes it into a permanent fixed image on the transfer sheet P.

Figure 12:
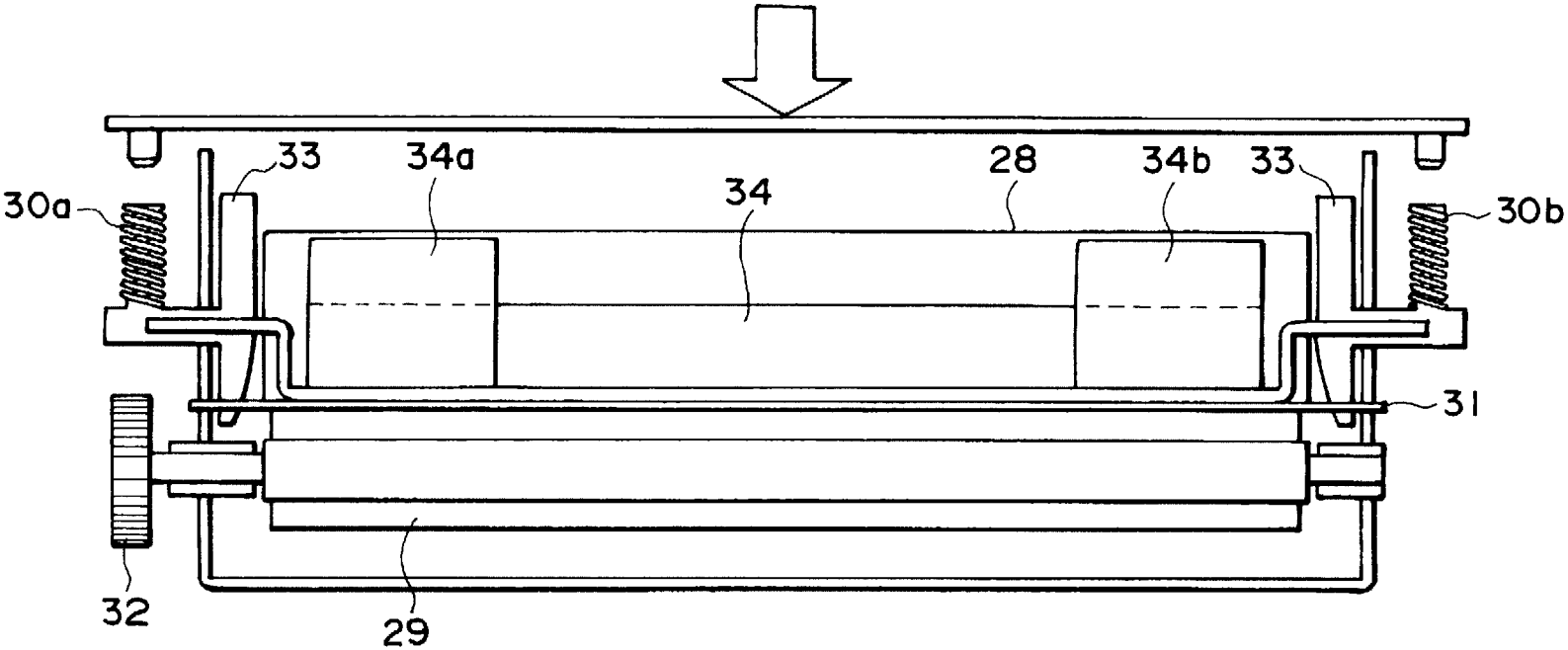
FIG. 12 is a sectional view of an image heating apparatus according to a further embodiment of the present invention.
Figure 13:
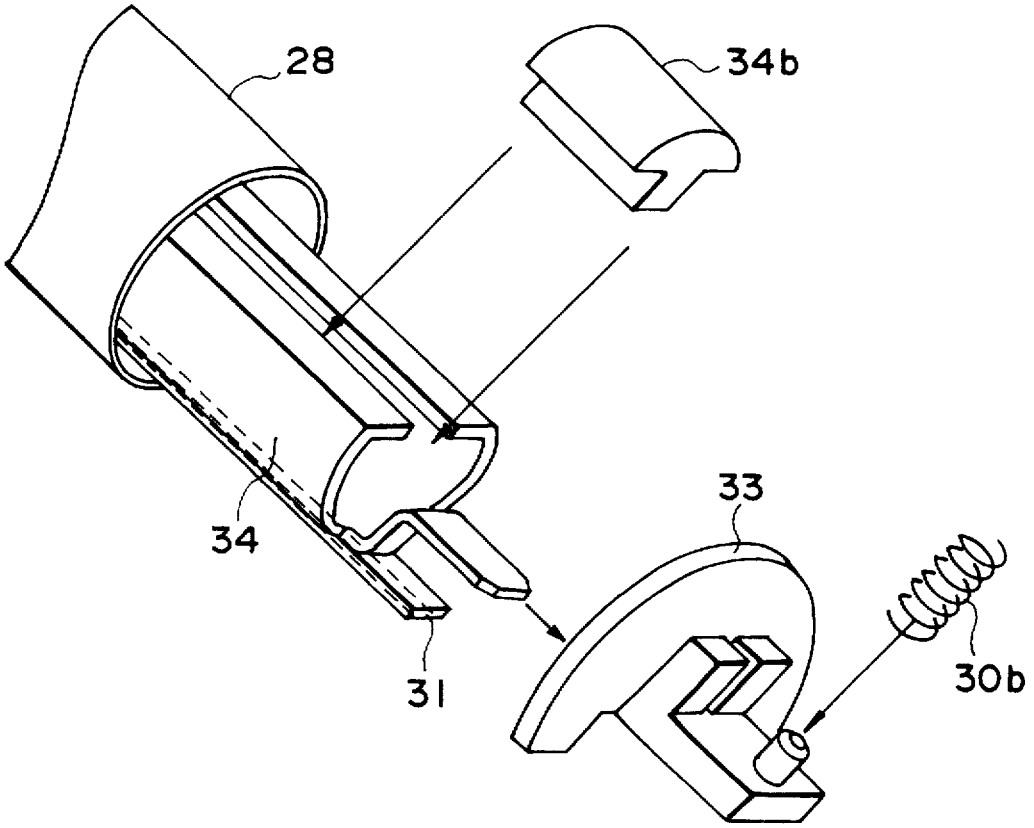
FIG. 13 is an exploded perspective view of the apparatus of FIG. 12.

FIGS. 12 and 13 are a sectional view of a heating apparatus 27 of this embodiment and a perspective view illustrating relations among a fixing film 28, limiting member 33, fixing film guide 34, end guiding members 34*a* and 34*b*. The fixing film 28 may be a single layer fixing film having a heat resistivity, toner releasing property and toughness, or a multi-layer film and surface treatment or laminated layer. More particularly, it may be a single layer film of polyester (PEP) or polyimide (PI) having a thickness of approx. 50 microns, which has been treated for heat resistivity, or a multi-layer film comprising the film and releasing layer of tetrafluoroethylene (PTFE) resin thereon.

In the heating apparatus 27, the fixing film 28 is an endless cylindrical form, and no tension is applied in the circumferential direction except for the nip portion, and it is rotated only by friction with the pressing roller 29.

A heater 31 contacted to the film guide 34 for guiding the inside surface of the fixing film 28 over the entire longitudinal region, and the pressing roller 29 are press-contacted toward each other with the fixing film 28 interposed therebetween, by pressure springs 30*a* and 30*b* (for example, total pressure of 3–6 kg in the case of A4 width). At the opposite longitudinal ends of the fixing film guide 34, the total guiding peripheral length L' for the inside surface of the fixing film, in relation to the internal circumferential length L of the fixing film, satisfy the following:

$$L>L'\geqq 0.8L$$

This is accomplished by the provisions of the end guiding members 34*a* and 34*b*.

On the surface of the heater 31, a thin layer heat generating resistor in the form of a line or stripe of $TaSiO_2$ silver-palladium, $Ta_2N$, $RuO_2$, nickel-chrome or the like, which may be formed by evaporation, sputtering, CVD, screen sprinting or the like. During the manufacturing, an end of the fixing film 28 is limited by a limiting member 33 mounted on the film guiding member 34, by which the lateral shifting of the fixing film 28 during the film drive of the heating apparatus 27, is limited.

The transfer sheet P having the transferred unfixed toner image is fed to the fixing nip together with the fixing film 28 by the surface friction force of the pressing roller 29 rotated by driving gear 32. At least in the fixing nip, the transfer sheet P is advanced at the same speed as the fixing film 28 and the pressing roller 29 without slippage by the contact pressure by the pressure springs 30*a* and 30*b* (pressing step), by which the heat from the heater 31 is transferred onto the transfer sheet P through the fixing film 28, so that the toner image T is fused and pressed on the transfer sheet P. After passing through the fixing nip, the transfer sheet P is moved together with the fixing film 28 by the adhesive force of the fused or softened toner T (cooling step), so that the heat is irradiated from the softened or fused toner T, so that the toner T is cooled and solidified into a permanent fixed image on the transfer sheet P. After the cooling, the transfer sheet P is easily separated from the fixing film 28 because the toner is cooled and solidified. After the separation, the transfer sheet P is discharged from the heating apparatus 27.

Figure 14:
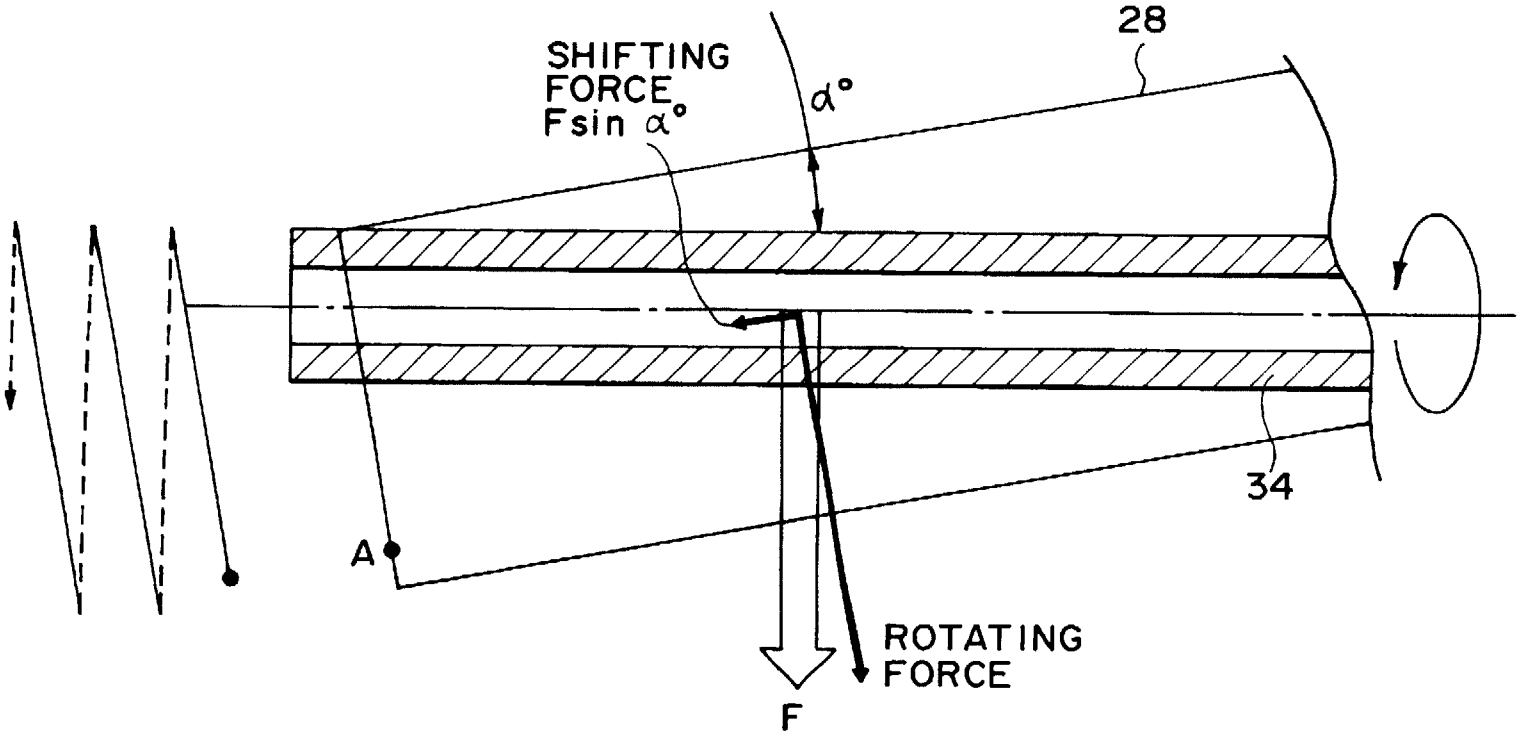
FIG. 14 is a top plan view illustrating a problem with film drive.

FIG. 14 is a top plan view of the fixing film 28 laterally shifted.

The lateral shifting of the fixing film 28 easily occurs particularly when the positional or dimensional accuracies of various members (particularly the heater 31 and the pressing roller 29) arc not enough, or when the temperature distribution occurs along the length of the heater so that the fixing film 28 feeding force is not uniform in the longitudinal direction, or when the manufacturing accuracy of the fixing film 28 (film thickness, cylindricity or the like) are not enough. FIG. 14 shows the lateral shifting force applied to the fixing film 28 at that time.

The film feeding force difference attributable to the above described factors inclines the central axis of the fixing film by α degrees relative to the fixing film guide and the flange depending on the degree of the difference between the inner circumferential length of the fixing film and a fixing film guide circumferential length. By force perpendicular to the longitudinal direction of the pressing roller (friction force) F, the fixing film 28 tends to laterally shift by the following force:

$$F \sin \alpha$$

However, in this embodiment, the angle α degree is controllable by the end guide 34*b* (34*a*) in FIG. 6, and therefore, the lateral shifting force itself occurring in the fixing film can be controlled.

Therefore, this embodiment provides the following advantageous effects.

By the end guiding members, the angle α degree formed between the central axis of the fixing film and the fixing film guide can be controlled, thus controlling the lateral shifting force of the fixing film. Therefore, the folding, crack and crease of the end portion of the fixing film can be avoided, by which the rotation of the fixing film is stabilized, so that the improper image fixing is reduced.

The burs and notches produced when the end portions of the fixing film is cut, have been strictly controlled. However, since this embodiment permits control of lateral shifting force of the fixing film, the manufacturing tolerances to the defects at the ends of the fixing film (such as end burs, notch or the like) are eased. The manufacturing cost can be decreased.

Figure 15:
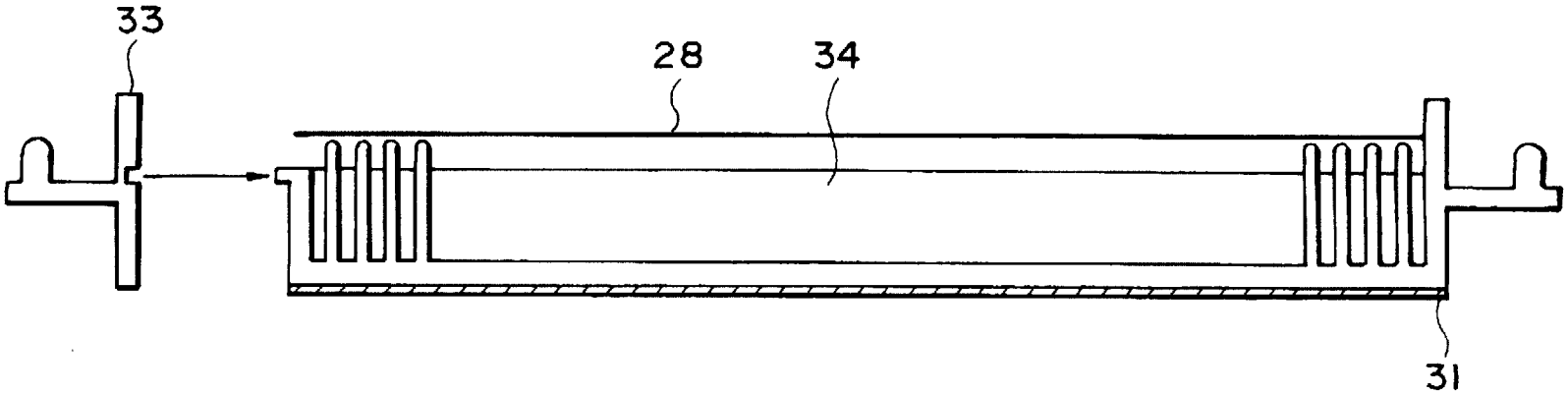
FIG. 15 is a sectional view of a film guide according to a further embodiment of the present invention.
Figure 16:
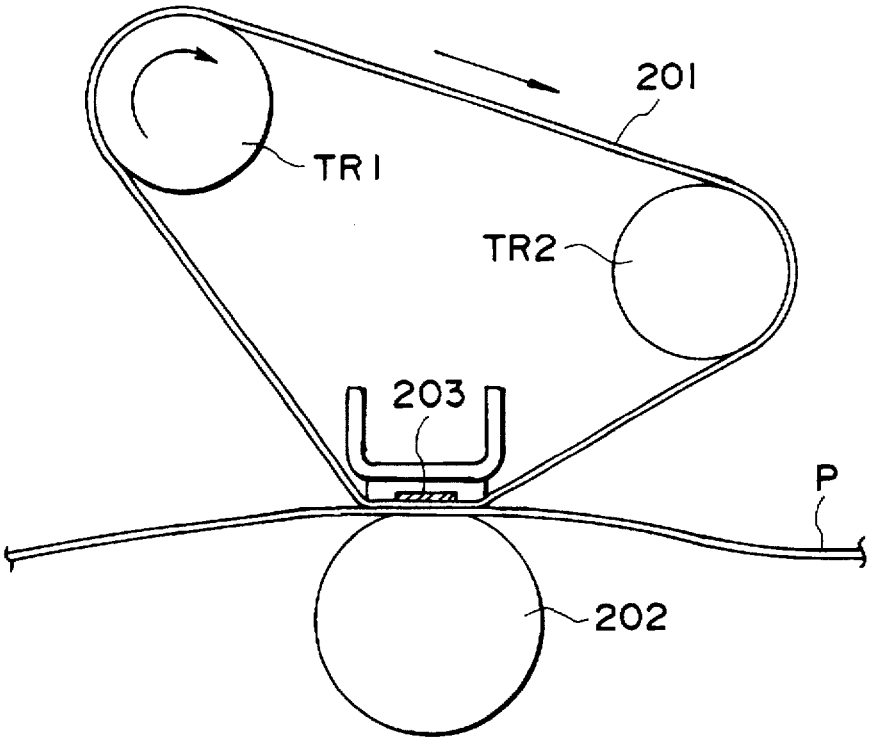
FIGS. 16 and 17 are sectional views of conventional image heating apparatuses.
Figure 17:
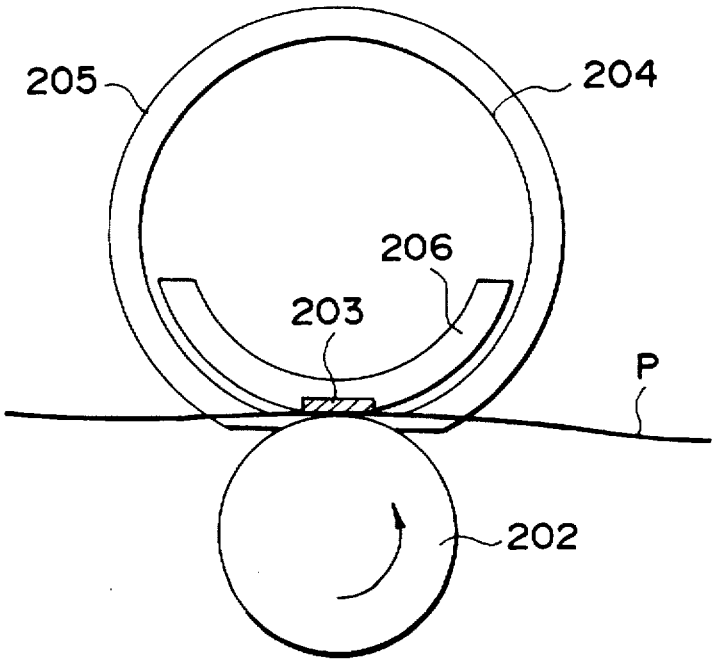

FIG. 15 shows a further embodiment. This Figure is a sectional view of a fixing film guide.

The fixing film guide 34 of this embodiment has guiding portions at the longitudinal opposite end portions so that the following is satisfied:

$$L>L'\geqq 0.8L$$

where L' is a circumferential of the guiding portions, and L is an internal circumferential length of the fixing film.

The guides at the opposite ends is in the form of a rib. The fixing film guide of this embodiment is of heat resistive resin material, and one of the members 33 for limiting ends of the fixing film is formed integrally.

According to this embodiment, at the end portions of the fixing film, the difference between the internal circumferential length of the fixing film and the circumferential length of the guide is controlled to control the lateral shifting force of the fixing film. Therefore, the damage at the end portions of the fixing film can be reduced, and the inspection of the cut edge is eased. In addition, the following advantageous effects can be provided.

By the integral formation of the end guiding members and the fixing film guide, it is possible to adjust with high precision the circumferential length of the guide relative to the internal circumferential length of the fixing film. In addition, by omitting a separate end guide members, the cost is reduced.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus comprising:

a heater;

an endless film extended around said heater;

a guiding member for guiding an internal surface of said film;

a cover for covering said film; and a driving rotatable member for driving an outer surface of said film, wherein said film is driven only by said driving rotatable member;

wherein said heater, said film, said guiding member and said cover form a unit which is detachably mountable to a main assembly of an image forming apparatus while said driving rotatable member remains in the image forming apparatus.

2. An apparatus according to claim 1, wherein said drive rotatable member cooperative with said heater to form a nip with said film interposed therebetween, and an image on a recording material is heated through said nip.

3. An image heating apparatus comprising:

a heater;

a movable endless film extended around said heater; and a guiding member for guiding an inside of said film, wherein said film is loosely extended along said guiding member, said guiding member having a first guiding portion extending perpendicular to a movement direction of said film and a second guiding portion provided at an end of said first guiding portion, wherein a central portion of said film is looser than a portion thereof guided by said second guiding portion, wherein a circumferential length of said second guiding portion is smaller than an internal circumferential length of said film, and is at least 0.8 times the internal circumferential length.

4. An apparatus according to claim 3, wherein said first guiding portion and second guiding portion are provided by a single member.

5. An apparatus according to claim 3, further comprising a limiting member for abutment to an end of said film, and said limiting member being a part of said guiding member.

6. An apparatus according to claim 3, further comprising a pressing rotatable member for driving an outer peripheral surface of said film and for forming a nip with said heater with said film therebetween.

7. An image forming apparatus comprising:

image forming means for forming an unfixed image on a recording material;

a heater;

an endless film extended around said heater;

a guiding member for guiding an internal surface of said film;

a cover for covering said film; and a driving rotatable member for driving an outer surface of said film, wherein said film is driven only by said driving rotatable member;

wherein the unfixed image formed by said image forming means is heated by heat from said heater through said film and is fixed on the recording material;

wherein said heater, said film, said guiding member and said cover form a unit which is detachably mountable to a main assembly of said image forming apparatus while said driving rotatable member remains in said image forming apparatus.

8. An image forming apparatus according to claim 7, wherein said driving rotatable member cooperates with said heater to form a nip with said film therebetween, wherein the unfixed image on the recording material is heated through said nip.

* * * * *

UNITED STATES PATENT AND TRADEMARK OFFICE

CERTIFICATE OF CORRECTION

PATENT NO. : 5,742,878
DATED : April 21, 1998
INVENTOR(S) : Akira KURODA

It is certified that error appears in the above-identified patent and that said Letters Patent is hereby corrected as shown below:

Column 1, line 64, delete "persons" and insert therefor --person--;
Line 65, delete "has" and insert therefor --have--.
Column 2, line 9, delete "members" and insert therefor --member--;
Line 14, delete "by", second occurrence, and insert therefor --from--;
Line 20, delete "portions" and insert therefor --portion--.
Column 3, line 31, delete "to";
Line 55, delete "51" and insert therefor --61--.
Column 5, line 5, delete "applies" and insert therefor --apply--;
Line 21, delete "finger" and insert therefor --fingers--.
Column 6, line 7, delete "handles" and insert therefor --handled--;
Line 27, delete "maim" and insert therefor --main--;
Line 29, delete "The and insert therefor --the--; and delete "B2" and insert therefor --62--;
Line 41, delete "is" and insert therefor --are--.
Column 7, line 4, delete "are", first occurrence, and insert therefor --or--;
Line 13, after "adjacent", insert --to--;
Line 25, after "87", delete the comma (",") and insert therefor a period (".");
Line 43, after "depending", insert --on--.
Column 8, line 22, delete "enter" and insert therefor --enters--;
Line 43, delete "apply" and insert therefor --applying--.

UNITED STATES PATENT AND TRADEMARK OFFICE

CERTIFICATE OF CORRECTION

PATENT NO. : 5,742,878

DATED : April 21, 1998

INVENTOR(S) : Akira KURODA

It is certified that error appears in the above-identified patent and that said Letters Patent is hereby corrected as shown below:

Column 9, line 50, delete "arc" and insert therefor --are--.

Signed and Sealed this

Twenty-seventh Day of October, 1998

*Attest:*

Bruce Lehman

BRUCE LEHMAN

*Attesting Officer*

*Commissioner of Patents and Trademarks*